US006805477B1

(12) United States Patent
Wu

(10) Patent No.: US 6,805,477 B1
(45) Date of Patent: Oct. 19, 2004

(54) ASSEMBLED LAMP WITH DETACHABLE LAMP ROD AND LAMP SEAT

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 9 days.

(21) Appl. No.: 10/400,992

(22) Filed: Mar. 25, 2003

(51) Int. Cl.[7] ..... F21V 17/00

(52) U.S. Cl. ..... 362/581; 362/365; 362/402; 362/457; 174/57; 174/65 R; 439/358

(58) Field of Search ..... 362/364, 365, 362/402, 418, 455, 457, 581; 248/342, 343; 439/357, 358; 174/52.1, 53, 54, 57, 60, 61, 65 R

(56) References Cited

U.S. PATENT DOCUMENTS 6,489,560 B1 * 12/2002 Wu ..... 174/65 R
6,502,966 B1 * 1/2003 Wu ..... 362/365
6,589,075 B1 * 7/2003 Wu ..... 439/550
6,617,513 B1 * 9/2003 Wu ..... 174/65 R
6,666,613 B2 * 12/2003 Wu ..... 403/299
6,685,346 B2 * 2/2004 Wu ..... 362/405
6,692,140 B2 * 2/2004 Wu ..... 362/370

* cited by examiner

*Primary Examiner*—John Anthony Ward

(57) ABSTRACT

An assembled lamp with a detachable lamp rod and lamp seat is disclosed. A wire winding box has a via hole and a bottom of the wire winding box has through hole. A portion of a lamp seat has a penetrating hole. One side of the lamp seat is formed with an embedding hole. A distal end of the lamp seat is locked with an inserting seat. The lamp rod is exactly inserted into the end portion in the lamp seat for electric conduction. The lamp rod is formed with a limit groove. The buckling elastic piece is protruded with an embedding end. After the lamp rod inserts into the lamp seat, the embedding end resists against the locking hole to prevent the lamp rod from protruding out. Thereby, a user can assembled the lamp rod and moreover, the lamp is detachable for storage and transfer with a smaller volume.

4 Claims, 6 Drawing Sheets

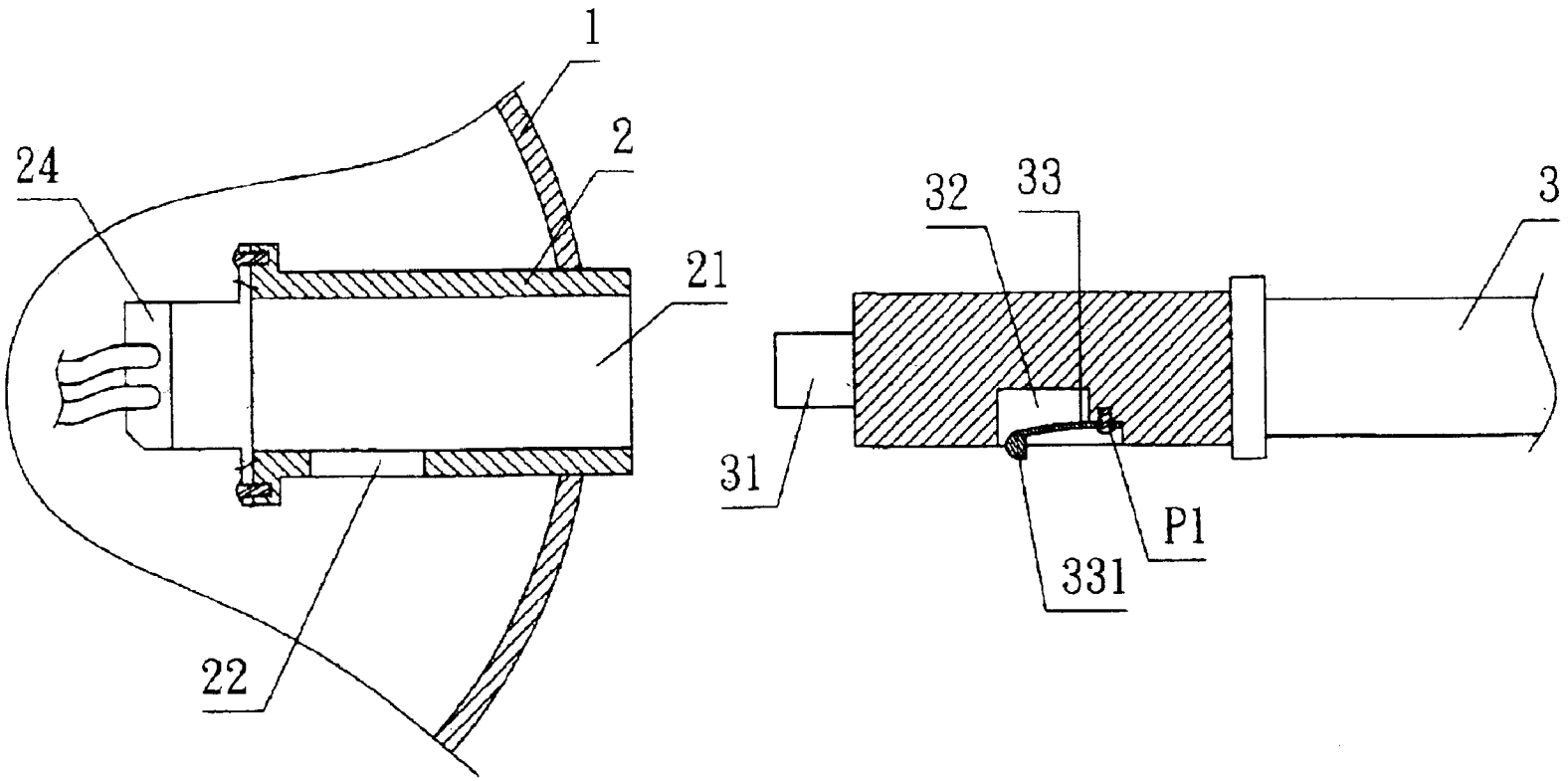
Fig. 3-A

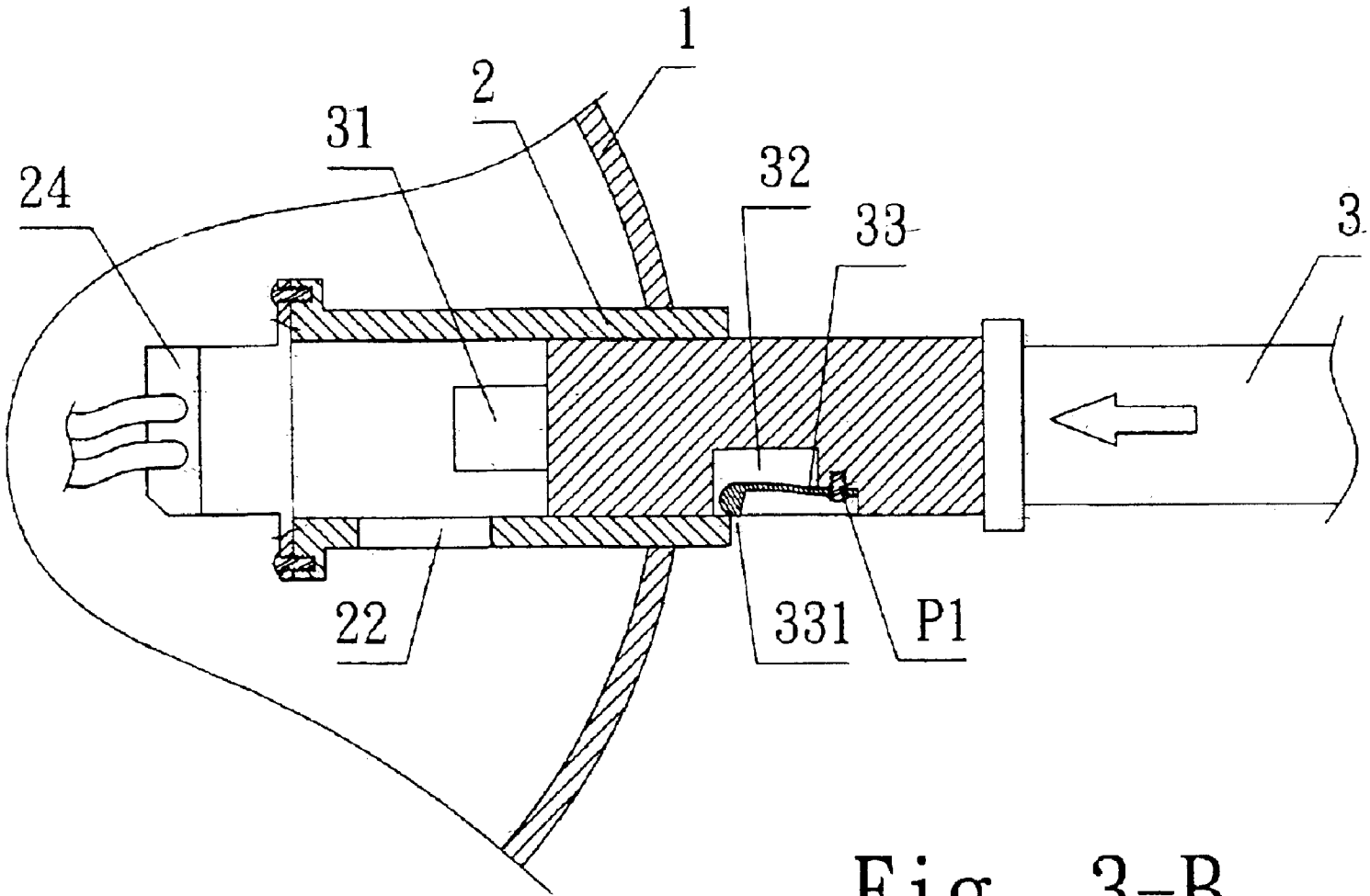
Fig. 3-B

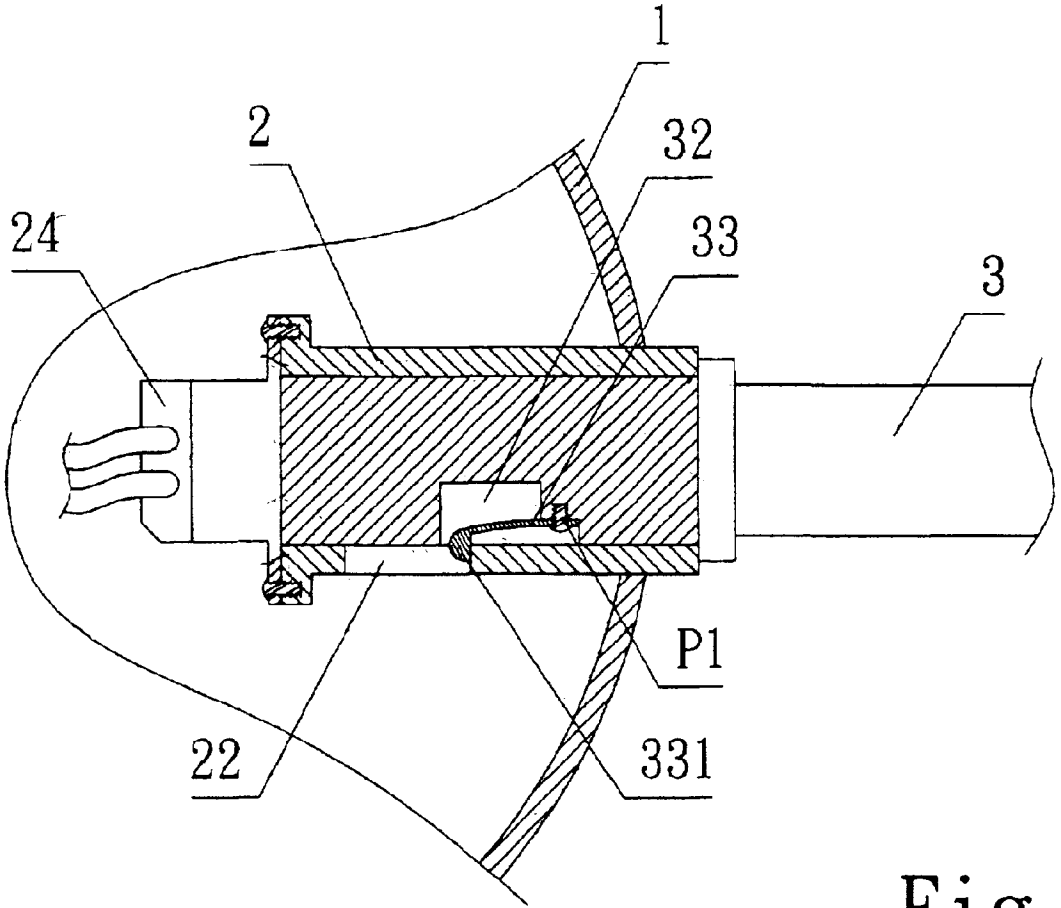
Fig. 3-C

ASSEMBLED LAMP WITH DETACHABLE LAMP ROD AND LAMP SEAT

BACKGROUND OF THE INVENTION

The present invention relates to lamp assembly devices, and particularly to an assembled lamp with a detachable lamp rod and lamp seat. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only the collision easy occurs, but also the locking tools (for example, spanners, openers, etc.) are necessary. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide an assembled lamp with a detachable lamp rod and lamp seat. A wire winding box has a via hole and a bottom of the wire winding box has through hole. A portion of a lamp seat has a penetrating hole. One side of the lamp seat is formed with an embedding hole. A distal end of the lamp seat is locked with ah inserting seat. The lamp rod is exactly inserted into the end portion in the lamp seat for electric conduction. The lamp rod is formed with a limit groove. The buckling elastic piece is protruded with an embedding end. After the lamp rod inserts into the lamp seat, the embedding end resists against the locking hole to prevent the lamp rod from protruding out. Thereby, a user can assemble the lamp rod and moreover, the lamp is detachable for storage and transfer with a small volume.

The various objects and advantages of the present invention will be more readily understood from the following detailed description when read in conjunction with the appended drawing.

BRIEF DESCRIPTION OF THE DRAWINGS

FIG. 3A shows one embodiment before the insertion of the lamp rod.

FIG. 3B shows one the present invention in the insertion of the lamp rod.

FIG. 3C shows one embodiment after the insertion of the lamp rod.

BRIEF DESCRIPTION OF THE PREFERRED EMBODIMENTS

Figure 1:
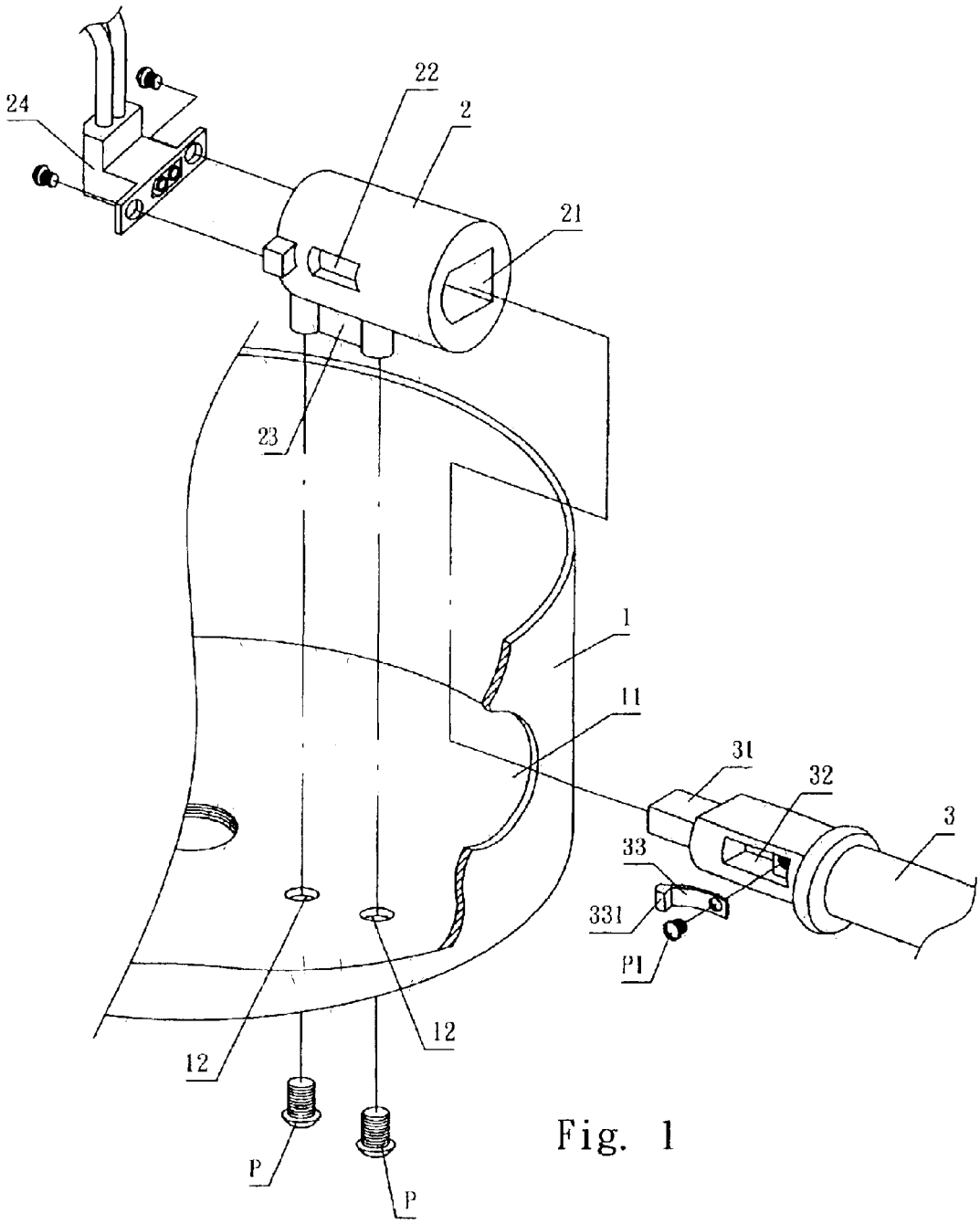
FIG. 1 is an exploded perspective view of the present invention.
Figure 2:
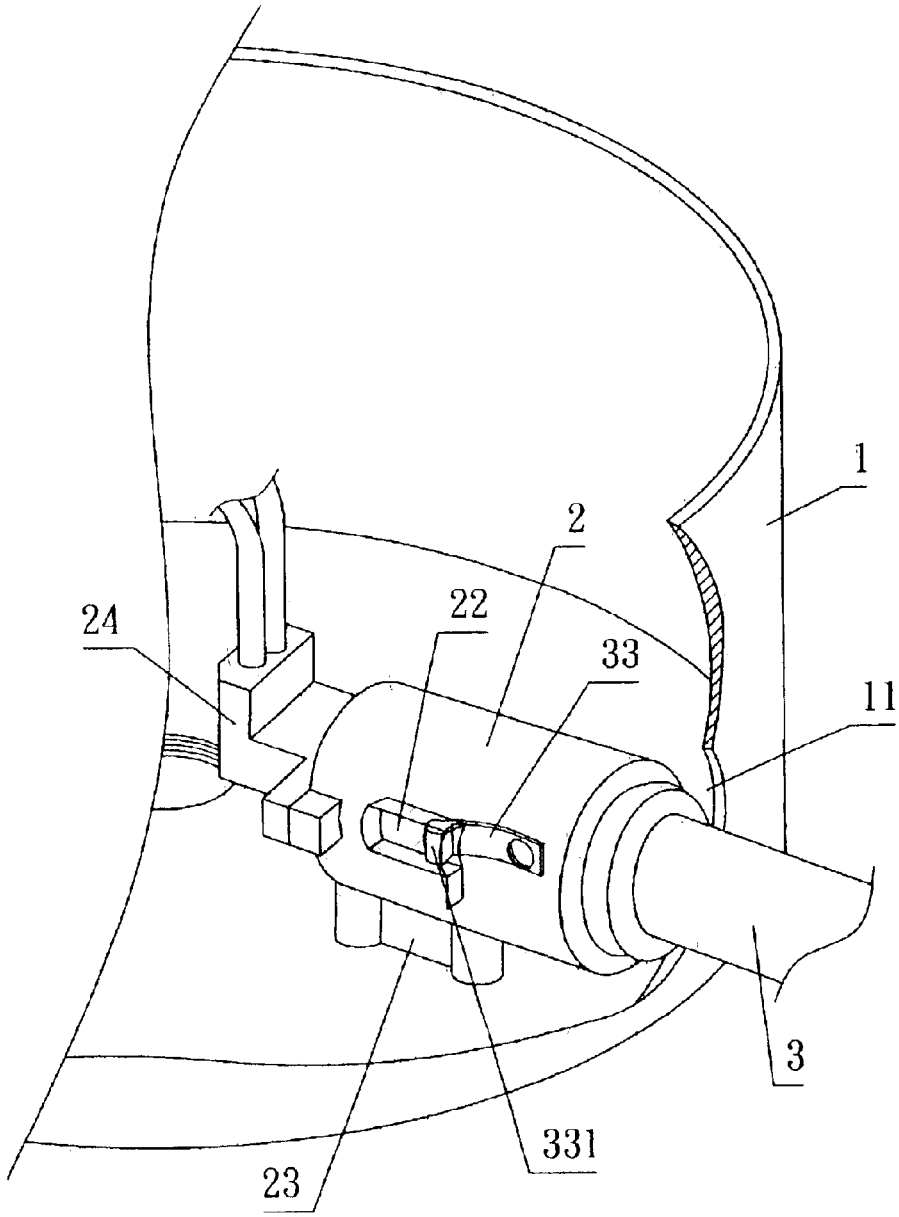
FIG. 2 is an assembled perspective view of the present invention.

Referring to FIGS. 1 and 2, the device of the present invention is illustrated. The present invention includes a lamp seat 2 firmly secured to a lateral side of a wire winding box 1, and a lamp rod 3 inserted into, the lamp seat 2.

A lateral side of the wire winding box 1 has a via hole 11 and a bottom of the wire winding box 1 coupled to the lamp seat 2 has through hole 12 for being passed by a stud P so as to lock the lamp seat 2 to a predetermined positioned.

A portion of the lamp seat 2 coupled to the via hole 11 of the wire winding box 1 has a penetrating hole 21. One side of the penetrating hole 21 has a round shape, and the other three sides of the penetrating hole 21 have a rectangular shape. Thereby, when the lamp rod 3 is inserted into the lamp seat 2, the lamp rod 3 cannot rotate. One side of the lamp seat 2 is formed with an embedding hole 22 penetrated axially on a surface of the lamp seat 2 for positioning the lamp rod 3. A bottom of the lamp seat 2 protruded with a locking seat 23 with a configuration corresponding to the through hold 12 of the wire winding box 1, thereby the stud P can pass through the through hole 12 from a lower end of the wire winding box 1 and then is locked to the locking seat 22 so as to fix the lamp seat 2 to the wire winding box 1. A distal end of the lamp seat 2 is locked with an inserting seat 24 which is exactly resisted by an end portion 31 of the lamp rod 3.

A front end of the lamp rod 3 is exactly inserted into the end portion 31 in the inserting seat 24 of the lamp seat 2 for electric conduction. A portion of the lamp rod 3 coupled to the embedding hole 22 of the lamp seat 2 is formed with a limit groove 32. A buckling elastic piece 33 is locked to the limit groove 32 by a stud P1. One end of the buckling elastic piece 33 near the lamp seat 2 is protruded with an embedding end 331 which slightly protrudes out of the limiting groove 32. Further, after the lamp rod 3 is inserted into the lamp seat 2, the embedding end 331 resists against the locking hole 22 so as to prevent the lamp rod 3 from being out of the lamp seat 2. By the design of the present invention, a user can assembled the lamp rod by inserting it into the lamp seat easily; and moreover, the lamp is detachable for storage and transfer with a smaller volume.

The Operation of the present invention will be described herein. At first, the lamp rod 3 is inserted into the penetrating hole 21 of the lamp seat 2. Then the embedding end 331 of buckling elastic piece 33 locking to the limit groove 32 is confined by the penetrating hole 21 of the lamp seat 2 so as to reduce into the penetrating hole 21. Thereby, it is pushed forward with the penetrating hole 21 (referring to FIG. 3B) until the buckling elastic piece 33 is aligned to the locking hole 22 of the lamp seat 2. The embedding end 331 of the buckling elastic piece 33 will separate from the penetrating hole 21 to be ejected out. Thereby, the protruding embedding end 331 exactly resists against the locking hole 22 of the lamp seat 2 to prevent the lamp rod 3 from moving outwards (referring to FIG. 3C). Thus, the lamp rod 3 is positioned on the lamp seat 2.

Figure 4:
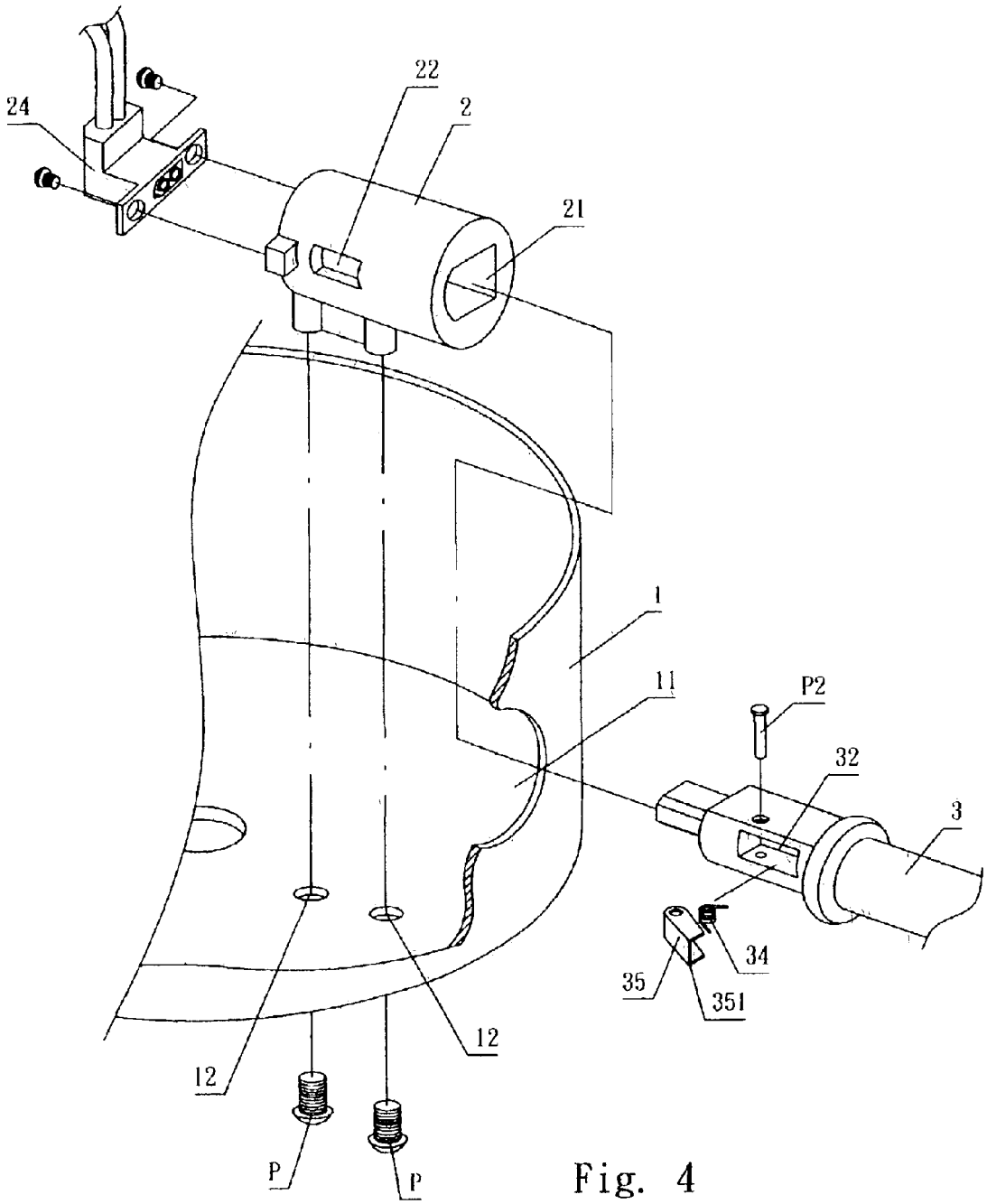
FIG. 4 shows another embodiment of the present invention.

Referring to FIG. 4, another embodiment of the present invention is illustrated. A portion of the lamp rod 3 coupled to the locking hole of the lamp seat 2 is formed with a limiting groove 32. A tension spring 34 and an embedding piece 35 are locked in the limiting groove 32 by using a stud P2 to pass through the two walls of the limiting groove 32, the tension spring 34 and the embedding piece 35. One end of the tension spring 34 resists against the limiting groove 32. Another end of the limiting groove 32 resists against the embedding piece 35. The tension spring 34 resists against the embedding piece 35 so that a buckling end 351 of the embedding piece 35 slightly protrudes out of the limiting groove 32. Thereby, when the lamp rod 3 is inserted into the lamp seat 2, the embedding piece 35 in the limiting groove 32 is pressed by in the penetrating hole 21 of the lamp seat 2 so as to be extruded. Thereby, the embedding piece 35 will protrude into the penetrating hole 21 so that the embedding end 351 exactly resists against the locking hole 22 of the lamp seat 2 to prevent the lamp rod 3 from separation.

By above said structure, in transferring or storage, the lamp rod 3 and the wire winding box 1 can be detached in advance so as to reduce the volume. In use, the user only needs to insert the lamp rod 3 into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims

What is claimed is:

1. An assembled lamp with a detachable lamp rod and lamp seat comprising: a lamp seat firmly secured to a lateral side of a wire winding box, and a lamp rod inserted into the lamp seat; wherein a lateral side of the wire winding box has a via hole and a bottom of the wire winding box coupled to the lamp seat his through hole; a portion of the lamp seat coupled to the via hole of the wire winding box has a penetrating hole; one side of the lamp seat is formed with an embedding hole penetrated axially on a surface of the lamp seat for positioning the lamp rod; a distal end of the lamp seat is locked with an inserting seat which is exactly resisted by an end portion of the lamp rod;

a front end of the lamp rod is exactly inserted into the end portion in the inserting seat of the lamp seat for electric conduction; a portion of the lamp rod coupled to the embedding hole of the lamp seat is formed with a limit groove; a buckling elastic piece is locked to the limit groove by a stud; one end of the buckling elastic piece near the lamp seat is protruded with an embedding end which slightly protrudes out of the limiting groove; further, after the lamp rod is inserted into the lamp seat, the embedding end resists against the locking hole so as to prevent the lamp rod from protruding out of the lamp beat;

thereby, a user can assemble the lamp rod by inserting it into the lamp seat easily; and moreover, the lamp is detachable for storage and transfer with a smaller volume.

2. The assembled lamp with a detachable lamp rod and lamp seat as claimed in claim 1, wherein one side of the penetrating hole, has a round shape, and the other three sides of the penetrating hole have a rectangular shape.

3. The assembled lamp with a detachable lamp rod and lamp seat As claimed in claim 1, wherein a bottom of the lamp seat protruded with a locking seat with a configuration corresponding to the through hole of the wire winding box, thereby the stud can pass through the through hole from a lower end of the wire winding box and then is locked to the locking seat.

4. The assembled lamp with a detachable lamp rod and lamp seat as claimed in claim 1, Wherein a tension spring and an embedding piece are locked in the limiting groove; one end of the tension spring resists against the limiting groove; another end of the limiting groove resists against the embedding piece; the tension spring resists against the embedding piece so that a buckling end of the embedding piece slightly protrudes out of the limiting groove; thereby, when the lamp rod is inserted into the lamp seat, the embedding piece will protrude into the penetrating hole so that the embedding end exactly resists against the locking hole of the lamp seat to prevent the lamp rod from separation.

* * * * *